United States Patent [19]

Focke et al.

[11] Patent Number: 4,895,251

[45] Date of Patent: Jan. 23, 1990

[54] HINGE-LID PACK FOR CIGARETTES

[75] Inventors: Heinz Focke; Kurt Liedtke, both of Verden, Fed. Rep. of Germany

[73] Assignee: Focke & Co. (GmbH & Co.), Verden, Fed. Rep. of Germany

[21] Appl. No.: 233,512

[22] Filed: Aug. 18, 1988

[30] Foreign Application Priority Data

Aug. 18, 1987 [DE] Fed. Rep. of Germany ..... 3727489

[51] Int. Cl.[4] ..... B65D 5/66

[52] U.S. Cl. ..... 206/273; 206/271; 229/160.1

[58] Field of Search ..... 206/265, 268, 271, 273; 229/16 A, 106, 160.1

[56] References Cited

U.S. PATENT DOCUMENTS

| | | | |
|---|---|---|---|
| 2,086,169 | 7/1937 | Molins | 206/273 |
| 2,944,555 | 7/1960 | Peel et al. | 206/273 |
| 4,729,508 | 3/1988 | Erdmann et al. | 229/160.1 |
| 4,753,383 | 6/1988 | Focke et al. | 229/160.1 |
| 4,753,384 | 6/1988 | Focke et al. | 229/160.1 |

FOREIGN PATENT DOCUMENTS

| | | |
|---|---|---|
| 7629556 | 4/1977 | Fed. Rep. of Germany . |
| 2551427 | 5/1977 | Fed. Rep. of Germany . |
| 8217180 | 1/1983 | Fed. Rep. of Germany . |
| 3308949 | 9/1984 | Fed. Rep. of Germany . |

*Primary Examiner*—David T. Fidei

*Attorney, Agent, or Firm*—Sughrue, Mion, Zinn, Macpeak & Seas

[57] ABSTRACT

Hinge-lid packs consisting of a pack part (11) and a hinged lid (12) articulated on said pack are well known as cigarette package. The hinge-lid packs have the standard international dimensions. For pack contents (cigarette group 10) which do not entirely fill the interior space of the hinge-lid pack a large-area projection (28; 40, 41) is disposed in the region of a pack rear wall (14) and/or a pack front wall (16). Said projection projects into the interior of the hinge-lid pack and rests against and provides support for the pack's contents (cigarette group 10). The projection (28; 40, 41) can be produced by means of embossing or by folding.

9 Claims, 3 Drawing Sheets

HINGE-LID PACK FOR CIGARETTES

DESCRIPTION

The invention relates to a hinge-lid pack consisting of foldable, thin cardboard or the like, especially for cigarettes, with a pack part having a front wall and a rear wall and with a hinge lid which is articulated on the rear wall of the latter.

This type of hinged box—also called hinge-lid pack—is well known for receiving cigarettes. The interior space of the hinge-lid pack is practically completely filled by the pack's contents, in the case of cigarettes by a group of cigarettes wrapped in an inner wrapper (tin foil blank). It is often desirable, however, to pack objects in the hinge-lid packs—not subject to change in size—which do not completely fill out the interior space. For example, cigarettes with a smaller diameter than is customary have recently been brought on the market. This results in smaller dimensions, especially less depth of the cigarette group. Hitherto, to compensate for the difference in dimensions in this type of pack a separate spacer made of a synthetic material (foamed polystyrene) has been fitted inside of the same. Because of this added spacer the manufacture of this type of pack is extravagant and costly.

The objective of the invention is to further develope and improve the hinge-lid pack such that objects, especially cigarette groups with dimensions msaller than those of the interior space of the hinge-lid pack, are supported and fixed inside of the hinge-lid pack without a separate spacer.

To achieve this objective the hinge-lid pack according to invention is characterized in that projections directed inwards and formed from the front wall and/or rear wall are disposed for the purpose of reducing the inside dimensions in the region of the rear wall and/or front wall of the pack part.

The projections serve to support the contents of the hinge-lid pack, especially the cigarette group, such that said cigarette group in spite of having a volume smaller than that of the hinge-lid pack, to a great extent is kept free of play within said pack.

The projections are formed into the walls of the hinge-lid pack and can have various shapes and sizes—depending on the shape of the contents of the hinge-lid pack.

The rear wall and/or front wall of the pack part of the hinge-lid pack are suited for applying large-area projections projecting into the pack's interior which provide suitable large-area support to the pack's contents.

The projectons can be produced in various ways. Appropriate embossing of a blank is favourable for producing the hinge-lid pack. Embossing is effected primarily by compression straining. Top and bottom dies act upon the blank in the region intended for forming the projection. Supplementarily, heat and moisture, if required, can be employed to improve the embossing process.

As an alternative the projections can be formed by folding the appropriate blank parts. In this case the rear wall and/or front wall are provided with folding lines formed into the blank which lead to the formation of the projection as a result of folding steps in the finishing of the hinge-lid pack.

Further features of the invention relate to the structure of the hinge-lid pack and to the production of the projections.

BRIEF DESCRIPTION OF THE DRAWINGS

Embodiments of the invention are exemplified below by means of the drawings. Shown are.

DETAILED DESCRIPTION OF THE INVENTION

Figure 1:
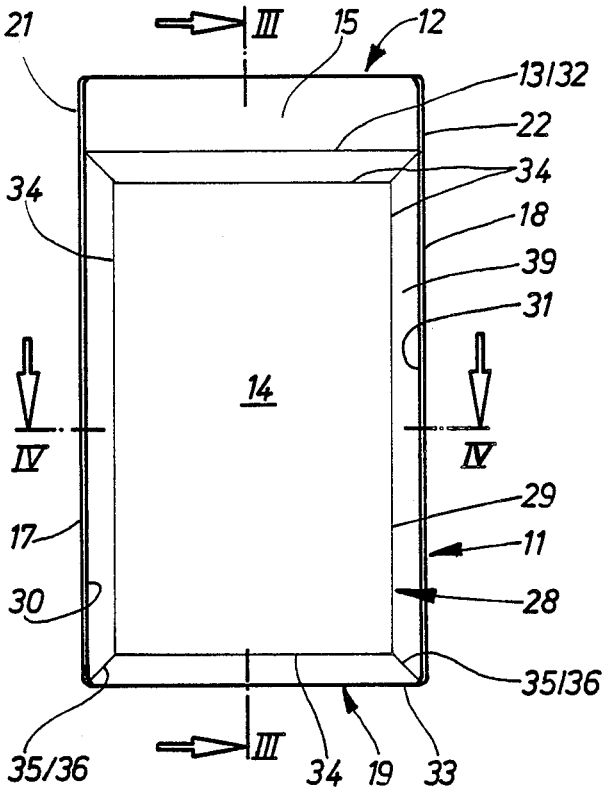
FIG. 1 a rear view of an embodiment of a hinge-lid pack.
Figure 2:
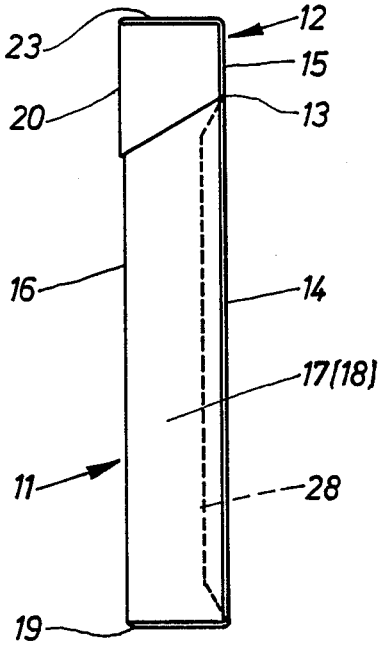
FIG. 2 a side view of the hinge-lid pack according to FIG. 1.
Figure 4:
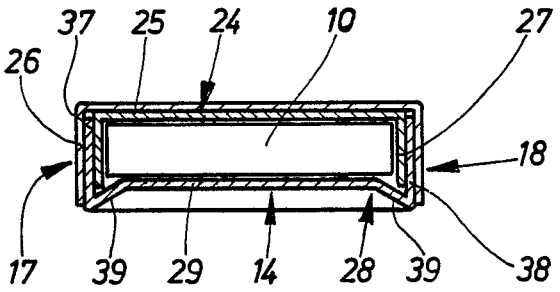
FIG. 4 a horizontal section along plane IV—IV of FIG. 1.
Figure 3:
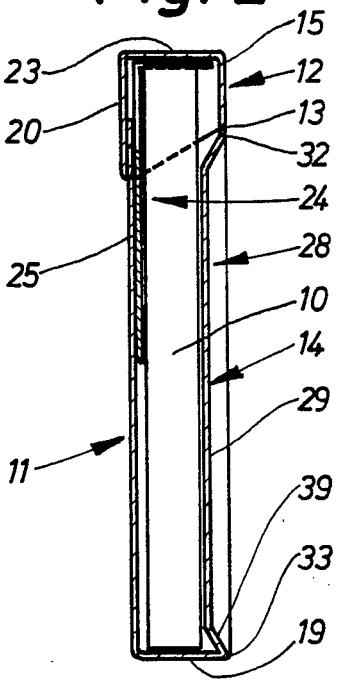
FIG. 3 a vertical section into plane III—III of FIG. 1.
Figure 5:
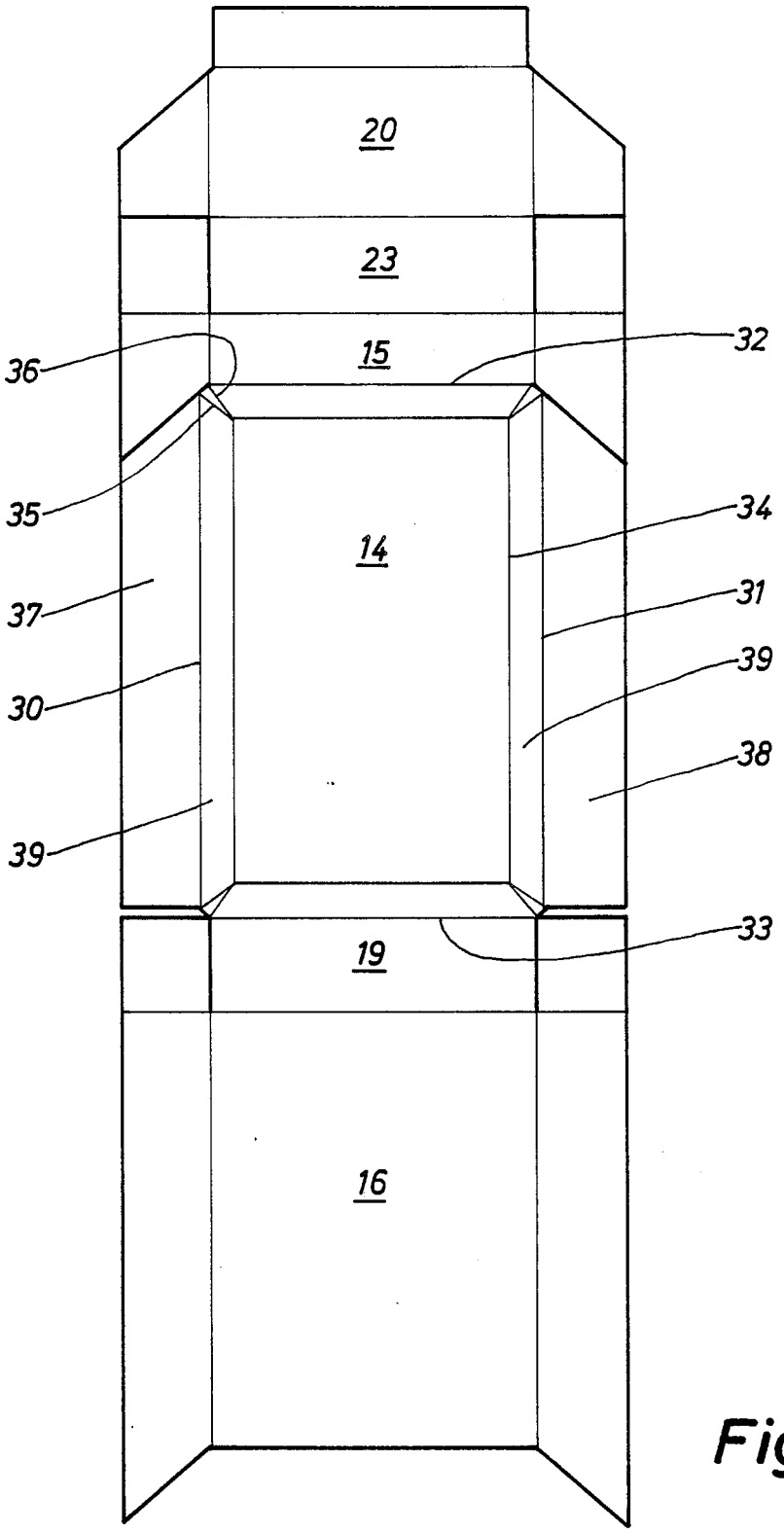
FIG. 5 a spread-out view of a blank for producing a hinge-lid pack according to FIGS. 1 to 4, FIG. 6 a spread-out view of a blank for producing another embodiment of a hinge-lid pack, FIG. 7 a vertical section through the blank according to FIG. 6.

The embodiments of hinge-lid packs illustrated in the drawings serve for receiving cigarette groups 10, represented schematically as a cuboidal block in FIGS. 3 and 4, namely as a cigarette group with an inner wrapper made of tin foil or the like. The basic structure of the hinge-lid packs corresponds to customary packages of this type. A pack part 11 and lid 12 have a hinged connection via a hinge line 13 in the region of a pack rear wall 14 and a lid rear wall 15.

The pack part 11 consists of—in addition to the pack rear wall 14—pack front wall 16, pack side walls 17, 18 and a bottom 19. The lid 12 comprises—in addition to lid rear wall 15—lid front wall 20, lid side walls 21, 22 and top wall 23. A collar 24 is situated inside the pack part; the collar front wall 25 and collar side walls 26, 27 of said collar are connected to the pack front wall 16 and pack side walls 17, 18 in the upper region of the pack part 11. An upper region of the collar 24 projects from the pack part 11 and, in the closed position, is surrounded by the lid 12.

The pack's contents, namely the wrapped cigarette group 10, has a volume smaller than the volume indicated by the outside dimensions of the hinge-lid pack. To fix the pack's contents in the hinge-lid pack, the pack rear wall 14 is provided with a projection 28 projecting inwards and formed from said wall as shown in the embodiment in FIGS. 1 to 5. Said projection extends practically over the entiremeasure of the pack rear wall 14. A supporting wall 29 of the projection 28 which is directed inwards rests against the pack's contents, thus forming a boundary and/or support for said contents within the hinge-lid pack.

In the embodiment according to FIGS. 1 to 5 the projection 28 is formed by folding. For this reason a blank (FIG. 5) for producing the hinge-lid pack is provided with folding lines which, when folding the hinge-lid pack into a three-dimensional shape, automatically or with the aid of suitable folding tools yields the projection 28. The folding lines are formed in the blank in the customary way by bevelling. Lateral folding lines 30, 31 corresponding to the shape of the projection 28 are provided for defining the projection 28 in relation to the pack side walls 17, 18; an upper folding line and a lower folding line 32, 33 for defining the projection 28 in relation to the lid 12 and the bottom 19 are provided as well. Parallel inner folding lines 34 are applied at a distance to the aforementioned folding lines 30..33. Said inner folding lines define a rectangle which also constitutes the size of the supporting wall 29.

From the corners of the rectangle defined by the inner folding lines 34 bevelled lines 35, 36 extend outwards towards the folding line 30..33. The bevelled lines 35, 36 diverge outwards from the corner point of the rectangle. This is possible because the lateral folding lines 30, 31 do not converge with the upper folding line 32 and the lower folding line 33 to form a corner point, but rather are spaced apart from one another. In relation to a vertical edge on the rear side of a conventional hinge-lid pack said lateral folding lines 30, 31 are laterally displaced, namely in the region of the side tabs 37, 38 as part of the pack side wall 17, 18. By folding the blank constructed thusly and as a result of the described arrangement of folding lines, the projection 28 is formed. Said projection receives a trapezoidal shape as a result of the oblique transitional walls 39 in vertical section as well as horizontal section.

Figure 6:
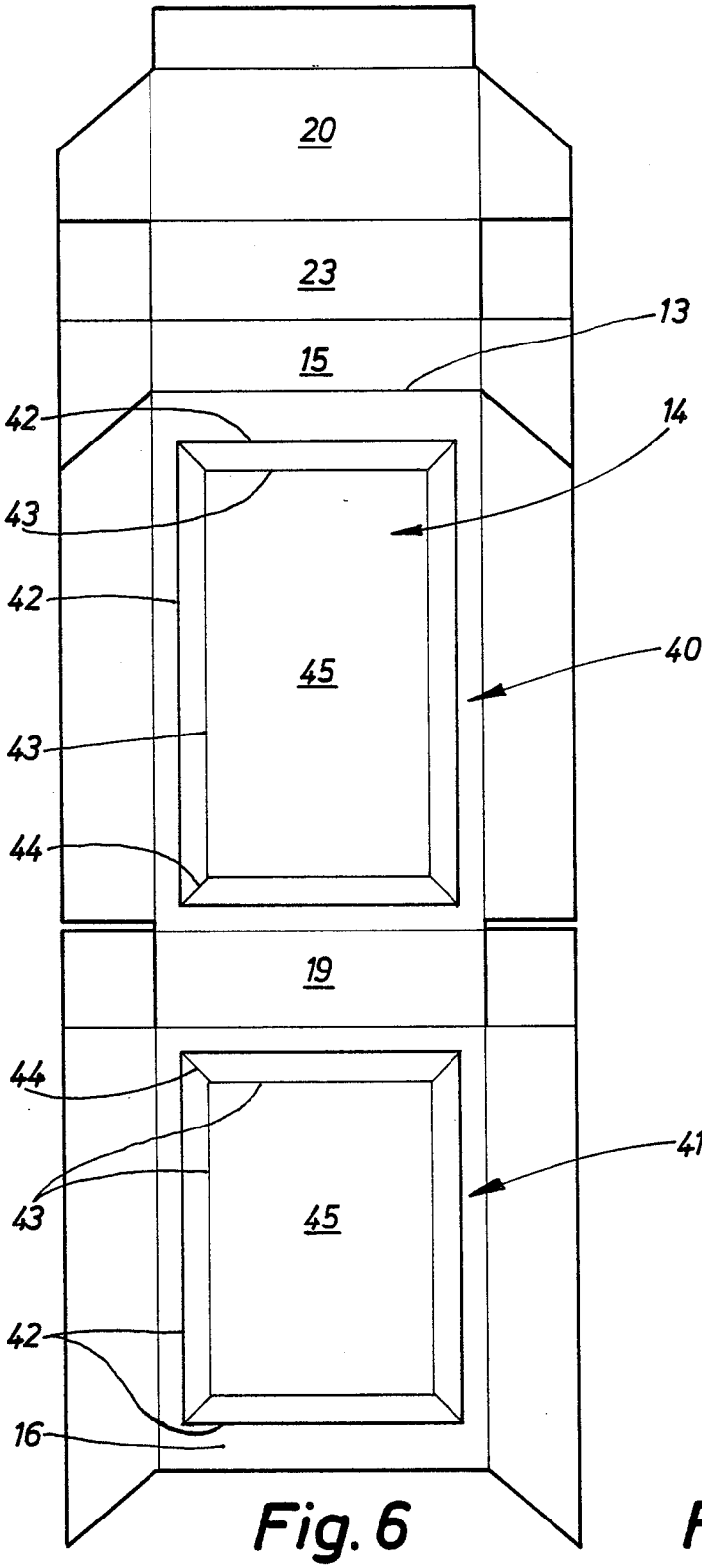
Figure 7:
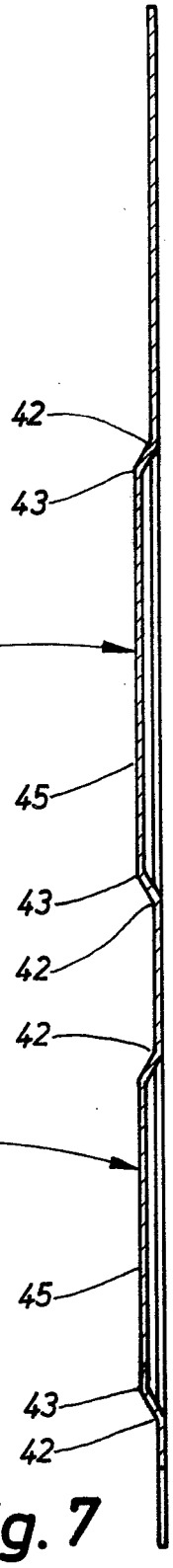

An alternative for a hinge-lid pack with projections in the region of the pack part is illustrated in FIGS. 6 and 7 by means of a spread-out blank. Here a projection 40, 41 is formed in the region of the pack rear wall 14 and also in the region of the pack front wall 16. These projections 40, 41 are formed by embossing the blank. Said blank in a spread-out condition is introduced into an embossing press with top and bottom dies. Embossing is carried out by means of pressure, if required in connection with heat and moisture, to form projections 40, 41.

The projections 40, 41 here are smaller in size than the surface of the pack rear wall 14 and/or the pack front wall 16. Nonetheless the projections 40, 41 form the predominant part of the aforementioned pack walls so that both sides of the pack's contents enjoy large-area support.

The shape of the projections 40, 41 is so selected that—as in the embodiment described above—a trapezoidal shape is obtained in vertical section and also in cross section. Each projection 40, 41 is defined by outer edges 42 and inner edges 43. The corner points of the edges 42, 43 combined to form a rectangle, are connected to one another by bevelled lines 44. This creates supporting walls 45 having a large, even area and directed inwards.

We claim:

1. Hinge-lid pack for cigarettes, consisting of thin, foldable material, such as cardboard or the like, with a pack part having a front wall and a rear wall and with a hinge lid which is articulated on said rear wall of said pack part, characterized in that projection means (28; 40, 41) diected inwards and formed from at least one of said pack rear wall (14) and said pack front wall (16) is disposed for the purpose of reducing the inside dimensions in the region of said walls of said pack part (11) from which said projection means is formed;

wherein said projection means comprises at least one supporting wall directed inwards and transitional walls directed transversely to said at least one supporting wall and leading into said pack wall from which said projection means is formed.

2. Hinge-lid pack according to claim 1, wherein said projection means comprises at least one large-area projection (28; 40, 41) which extends over nearly the entire surface of said wall from which it is formed.

3. Hinge-lid pack according to claims 1 or 2, wherein said projection means (28; 40, 41) is disposed in regions of a blank which are associated with said walls from which said projection means is formed, and is applied before folding of said pack.

4. Hinge-lid pack according to claim 3, wherein said projection means (40, 41) is formed by embossing said blank.

5. Hinge-lid pack according to claim 3, wherein said projection means (28) is formed by means of folding, whereby folding lines (30..36) are formed into said blank for defining said projection means (28).

6. Hinge-lid pack according to claim 1, wherein said projection means (28) is formed by means of folding so as to cover the entire surface of said pack rear wall (14), said transitional walls (39) leading to lateral and upper and lower edges of said pack rear wall (14).

7. Hinge-lid pack according to claim 1, wherein said projection means (28) is formed by means of folding, and a plurality of outwardly disposed lateral folding lines (30, 31) are displaced in said pack rear wall (14) for laterally defining said projection means (28) outwards in the region of a plurality of side tabs (37, 38) to form a plurality of pack side walls (17, 18).

8. Hinge-lid pack according to claim 1, wherein said projecton means (28) is formed by means of folding, such that a plurality of diverging bevelled lines (35, 36) are formed between corner points of a plurality of inner folding lines (34) which are disposed inside said diverging bevelled lines, and ends of a plurality of lateral folding lines (30, 31) and an upper folding line (32) and a lower folding line (33), which are disposed outside said diverging bevelled lines.

9. Hinge-lid pack for cigarettes, consisting of thin, foldable material, such as cardboard or the like, with a pack part having a front wall and a rear wall and with a hinge lid which is articulated on said rear wall of said pack part, characterized in that projection means (28; 40, 41) directed inwards and formed from at least one of said pack rear wall (14) and said pack front wall (16) is disposed for the purpose of reducing the inside dimensions in the region of said walls of said pack part (11) from which said projection means is formed, said projection means further comprising a large area supporting wall (29; 45) directed inwards and a plurality of transitional walls (39) directed transversely to said supporting wall and leading into said pack wall from which said projection means is formed.

* * * * *